United States Patent [19]

Howard

[11] 4,414,516

[45] Nov. 8, 1983

[54] POLARIZED SIGNAL RECEIVER SYSTEM

[75] Inventor: H. Taylor Howard, San Andreas, Calif.

[73] Assignee: Chaparral Communications, Inc., San Jose, Calif.

[21] Appl. No.: 322,446

[22] Filed: Nov. 18, 1981

[51] Int. Cl.[3] ..... H01P 1/165

[52] U.S. Cl. ..... 333/21 A; 333/254; 343/786

[58] Field of Search ..... 343/786, 756; 333/21 A, 333/21 R, 254, 249

[56] References Cited

U.S. PATENT DOCUMENTS 2,548,821 4/1951 Riblet et al. ..... 343/786
2,742,612 4/1956 Cohn ..... 333/21 R
2,880,399 3/1959 Murphy ..... 333/21 R X
3,681,714 8/1972 Terakawa ..... 333/254
4,168,504 9/1979 Davis ..... 343/786

*Primary Examiner*—Paul L. Gensler
*Attorney, Agent, or Firm*—F. D. La Riviere

[57] ABSTRACT

A rotatable polarized signal receiver in a system for receiving linearly polarized electromagnetic signals includes a signal conductor having a receiver probe portion, oriented in a circular waveguide parallel to the polarization of the incident signal, and signal launch probe portion extending into the rectangular waveguide orthogonal to the direction of signal transmission therein, mounted concentrically in an insulator rod through perpendicular coupling of the circular and rectangular waveguides.

15 Claims, 3 Drawing Figures

POLARIZED SIGNAL RECEIVER SYSTEM

BACKGROUND AND SUMMARY OF THE INVENTION

In satellite retransmission of communication signals, two linearly polarized signals, rotated 90 degrees from each other, are used. In less expensive installations for receiving such signals, the feed horn for the receiving system is installed with the orientation parallel to the desired signal polarization. The other polarization is not detected and is simply reflected back out of the feed horn. For more expensive installations, the entire feed horn and low noise amplifier system is mounted on a rotator similar to the type used on home television antennas to select the desired signal polarization.

While the above-mentioned systems are cost effective, they are mechanically cumbersome and limit system performance. Other prior art signal polarization rotators electrically rotate the signal field in a ferrite media. While such rotators eliminate the mechanical clumsiness of the above-described rotators, they are expensive and introduce additional signal losses (approximate 0.2 DB) into the receiving system. See, for example, such an electronic antennae rotator marketed under the trade name "Luly Polarizer" by Robert A. Luly Associates, P. O. Box 2311, San Bernardino, CA.

The present invention eliminates the mechanical disadvantages of several prior art rotators and eliminates signals losses associated with other prior art rotators. A signal detector constructed according to the principles of the present invention comprises a transmission line having a signal receiver probe portion ("RP portion") and a signal launch probe portion ("LP portion") mounted in dielectric rod at the one end of a circular waveguide and a rectangular waveguide perpendicularly coupled to the circular waveguide. The RB portion of the transmission line detects polarized incoming signals in the circular waveguide and the LP portion launches the detected signal into the rectangular waveguide for transmission to a low noise amplifier ("LNA").

In the preferred embodiment, the transmission line, by its coupling to the insulator rod, may be rotated continuously and selectively by a servo motor mounted on the waveguide assembly. As the RP portion rotates to receive the desired signal, the LP portion also rotates. However, the launched signal or the signal received at the LNA is unaffected because rotation of the LP portion is about its axis of symmetry in the rectangular waveguide. The RP portion in the circular waveguide rotates between the two orthogonally polarized signals impinging on the feed horn. By rotation to the desired polarization, that signal is received and the other reflected. The selected signal is then conducted along the transmission line to the rear wall of the circular waveguide portion of the feed horn and is launched into the rectangular waveguide by the LP portion.

DESCRIPTION OF THE PREFERRED EMBODIMENT

Figure 1:
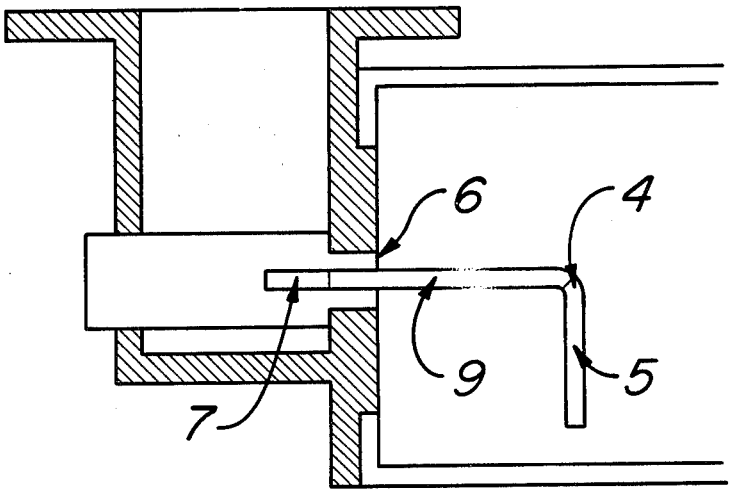
Prior Art Fig. 1
FIG. 1 is a cross-sectional view of a prior art waveguide assembly with an internal rotating signal detector.

Referring first to FIG. 1, prior art mechanical internal rotating signal receivers provided low impedances coaxial transmission line through the back of the circular waveguide at 6 to LP portion 7. However, RP portion 5 of transmission line 9 presents an incorrect impedance to the incident signal, because the energy is coupled from the high impedance end of RP portion 5 at 4 by transmission line portion 9 and the low impedance end of RP portion 5 is open circuited. Thus, the transmission line and RP portion impedance present in this configuration are reversed for effective detection of an incident wave.

Figure 2:
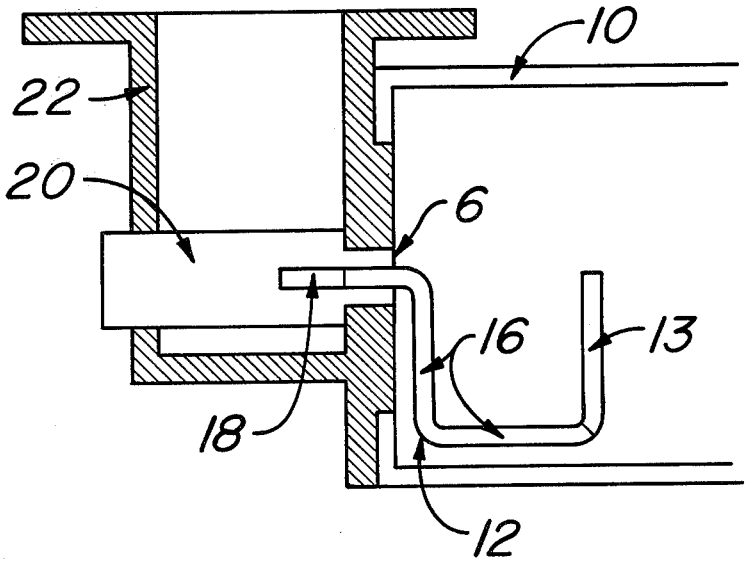
FIG. 2 is a cross-sectional view of a waveguide assembly with internal rotating signal detector constructed according to the principles of the present invention.

Referring now to FIG. 2, one embodiment of the present invention comprises circular waveguide 10 perpendicularly coupled to rectangular waveguide 22 and including signal conductor 12 fixedly mounted in insulator 20. Signal conductor 12 includes RP portion 13 oriented orthogonal to the axis of symmetry of circular waveguide 10, LP portion 18 extending into, and orthogonal to the axis of, waveguide 22, and coupled to RP portion 13 by conductor portions 16. Signal conductor 12 is typically constructed of a single, continuous homogenous electrical conductor wherein RP portion 13 is approximately one-quarter wavelength long and transmission line portions 16 form a transmission line in the same manner that any single wire above a ground plane becomes a transmission line. The portion of signal conductor 12, extending through the rear wall of round waveguide 10 at 6, forms a low impedance coaxial transmission line. LP portion 18 launches the detected signal into rectangular waveguide 22.

Insulator 20, constructed of polystyrene or other suitable dielectric rod, provides mounting for signal conductor 12, electrical insulation of the line from the walls of waveguides 10 and 22, and for selective rotation of signal conductor 12 about its axis of symmetry. Since signal conductor 12 is concentric with axis of rotation of insulator 20, rotation of insulator 20 about its axis rotates LP portion 18, which correspondingly rotates RP portion 13 orthogonally about the axis of symmetry of waveguide 10. RP portion 13 is thereby oriented to the polarity of the desired incident signal for detection.

Figure 3:
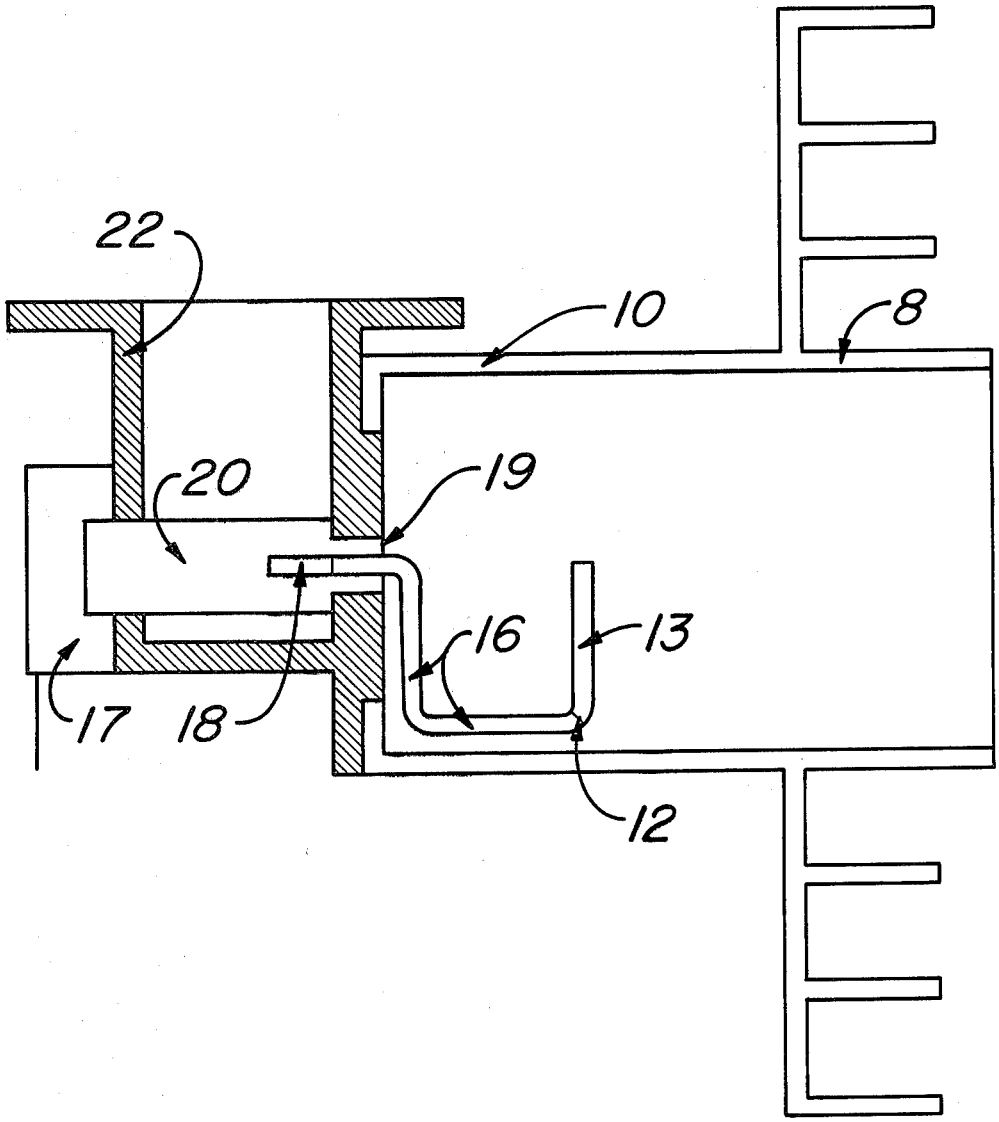
FIG. 3 is a cross-sectional view of the waveguide assembly and internal rotating signal detector of FIG. 2 further including a feed horn.

The preferred embodiment of the present invention is shown in FIG. 3. In this configuration, circular waveguide 10 is coaxially coupled to feed horn 8 at one end and perpendicularly coupled to rectangular waveguide 22 at the other end. As in the configuration of FIG. 2, signal conductor 12 is coupled to insulator 20, which is coupled to servo motor 17 for positioning. Servo motor 17 is usually the same as or similar to servo motors used in remotely controlled model aircraft for control surface movement. Obviously, with the addition of servo motor 17, operation of the detector system may be remotely controlled from the operator's control panel. Feed horn 8 is of the type described in U.S. patent application Ser. No. 271,815, filed on June 8, 1981. It could also be of any other suitable type such as described in U.S. patent application Ser. No. 271,130, now abandoned or the U.S. patent application Ser. No. 292,509 entitled "Improved Feed Horn for Reflector Antennae" filed Aug. 13, 1981 now U.S. Pat. No. 4,380,014.

The direction of signals transmitted in waveguide 22 is orthogonal to the direction of signals transmitted in waveguide 10. This configuration facilitates the simplicity of the present invention, since launching of signals into waveguide 22 is insensitive to rotation of LP portion 18, which rotation directly results from rotation of RP portion 13 necessary to select the desired signal.

LP portion 18 is capable of launching the detected signal into another waveguide of any shape or into coaxial cable transmission line. Thus, as the transmission line 12 rotates, RP portion 13 rotates orthogonally to, and LP portion 18 rotates concentrically with the axis of symmetry of the round waveguide. As the RP portion aligns with the desired linearly polarized signal present in the circular waveguide, the signal is detected and conducted along the transmission line to the LP portion, which launches the detected signal. As stated earlier in this specification, the launched signal or the signal received at the LNA (not shown) is unaffected by the orientation of RP portion 13 because LP portion 18 rotates about its axis of symmetry and such rotation retains the relative position of LP portion 18 with waveguide 22.

I claim:

1. A polarized signal receiver comprising:

a first waveguide for transmitting polarized signals;

a circular waveguide for receiving polarized signals at one end and coupled to the first waveguide at the other end, said other end having a rear wall;

an insulator rod, rotatably mounted through said other end of the circular waveguide; and signal conducting means, fixedly mounted in the insulator rod concentric with the axis of rotation thereof having a receiver probe portion oriented in the circular waveguide orthogonal to the axis of said circular waveguide for receiving one polarization of the incident signal, a launch probe portion concentric with the insulator rod and extending into the first waveguide for launching said signal therein, and a transmission line portion, having a first section contoured to the inside surface of the circular wall, and substantially parallel to the axis, of the circular waveguide, and having a second section contoured to the inside surface, and substantially parallel to the plane, of the rear wall of the circular waveguide, for connecting the receiver probe portion to the launch probe portion.

2. A polarized signal receiver as in claim 1 further including a feed horn for receiving incident polarized signals, coaxially coupled to said one end of the circular waveguide.

3. A polarized signal receiver as in claim 1 further including remotely controllable motor means coupled to the insulator rod for selectively rotating the signal conducting means mounted therein.

4. A polarized signal receiver as in claim 1 or 2 wherein the inside surfaces of the rear and circular walls of the circular waveguide form waveguide walls and the ground plane element of the transmission line portion.

5. A polarized signal receiver as in claim 1 or 2 wherein the launch probe is orthogonal to the direction of signal transmission in the first waveguide.

6. A polarized signal receiver as in claim 1 or 2 wherein the first waveguide is a rectangular waveguide.

7. A polarized signal receiver as in claim 1 or 2 wherein the first waveguide is a circular waveguide.

8. A polarized signal receiver as in claim 1 or 2 wherein the first waveguide is a square waveguide.

9. A polarized signal receiver as in claim 1 or 2 wherein the first waveguide is an elliptical waveguide.

10. A polarized signal receiver as in claim 1 or 2 wherein the signal conducting means is a single continuous electrical conductor.

11. A polarized signal receiver as in claim 1 or 3 wherein the receiver probe portion is approximately one-quarter wavelength long.

12. A polarized signal receiver as in claim 1 or 3 wherein the signal conducting means is selectably rotatable to orient the receiver probe for receiving different polarizations of incident signals.

13. A polarized signal receiver as in claim 12 wherein the impedance of the launch probe and transmission line portions is substantially unaffected by the orientation of the receiver probe portion around the axis of the circular waveguide.

14. A polarized signal receiver as in claim 1 wherein the first and second sections of the transmission line portion and the launch probe portion all have substantially uniform impedance at the frequency of the signal received.

15. A polarized signal receiver as in claim 1 wherein said first section of the transmission line portion is generally parallel to the axis and near the surface of the circular wall of the circular waveguide, and said second section of the transmission line portion is generally parallel to the plane, and near the surface, of the rear wall of the circular waveguide, said circular waveguide walls forming the ground plane of said transmission line portion.

* * * * *